United States Patent [19]

Musgrave

[11] 3,939,590

[45] Feb. 24, 1976

[54] MAGAZINE EMPTYING DEVICE

[76] Inventor: Daniel D. Musgrave, 8201 Caraway St., Cabin John, Md. 20731

[22] Filed: Sept. 11, 1974

[21] Appl. No.: 504,901

[52] U.S. Cl. ..... 42/90; 42/1 R
[51] Int. Cl.[2] ..... F41C 27/00
[58] Field of Search ..... 42/1 R, 90, 87

[56] References Cited

UNITED STATES PATENTS

| | | | |
|---|---|---|---|
| 856,016 | 6/1907 | Balson | 42/1 R |
| 1,028,008 | 5/1912 | Eslick, Jr. | 42/1 R |
| 2,137,491 | 11/1938 | Huff | 42/90 |
| 2,514,277 | 7/1950 | Donnallan | 42/90 |
| 2,864,193 | 12/1958 | Drew | 42/1 R |
| 3,153,296 | 10/1964 | Hofstetter | 42/87 |
| 3,509,655 | 5/1970 | Wilhelm | 42/87 |

*Primary Examiner*—Charles T. Jordan

[57] ABSTRACT

A device for rapidly emptying a cartridge magazine of the type which feeds alternately from a right and a left feed lip. The top-most cartridge in the magazine is disengaged from the feed lip by slightly depressing the other cartridges in the magazine. The top cartridge can then fall out. The process is repeated as each cartridge reaches the top. The last cartridge is disengaged by slightly depressing the follower.

8 Claims, 12 Drawing Figures

MAGAZINE EMPTYING DEVICE

The detachable magazine has become the predominant type for modern firearms and particularly for military firearms. The most commonly used type holds the cartridges in a stack consisting of two staggered rows. The term stack is appropriate because the cartridges move toward the feeding positions as a group. At the feeding positions are curved retaining lips, commonly known as feed lips. There are two such lips, which alternate in retaining the top cartridge in a feeding position ready for ramming into the barrel. The distance between the lips is greater than the diameter of the cartridge, so the magazine can readily be filled by pressing cartridges through the space between the lips, whereupon they take up the described stack formation with the topmost cartridge engaging one of the lips. The entire stack is pushed toward the lips by the cartridge follower, which is acted on by the compressed magazine spring.

Enormous quantities of magazines are in use today. In military forces each user carries several extra magazines for his firearm. Experience has shown that these extra magazines and those carried in the firearm itself are sometimes exposed to sand, dust, and other foreign matter, which can adhere to the cartridges and cause malfunctioning of the firearm.

The obvious remedy is to clean the magazines and cartridges as soon as convenient after exposure to foreign matter. The cartridges can be removed from the magazine by hand but this is a relatively slow operation and is somewhat of an inconvenience. A quicker and easier method of emptying magazines would encourage the user to perform cleaning whenever necessary.

In consideration of the foregoing the principal object of this invention is to provide a magazine emptying device.

Another object is to provide a magazine emptying device which may be mounted on a firearm, or on accessories for a firearm.

These and other objects of the present invention will be apparent upon reference to the following specification, taken in connection with the accompanying drawings, wherein.

Figure 1:
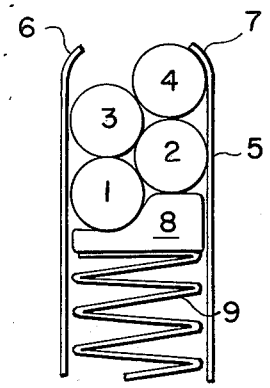
FIG. 1 is a cross-section of the feed end of a typical magazine with cartridges therein.

Referring now to the drawings in detail, FIG. 1 shows a portion of a cartridge magazine having a casing 5, lips 6 and 7, and a follower 8 which is pushed toward the lips by spring 9. Also within the casing are cartridges 1, 2, 3, and 4. Cartridge 4 is engaged with lip 7 in the well-known manner as a result of the thrust of the spring against the follower and the stack of cartridges.

Figure 2:
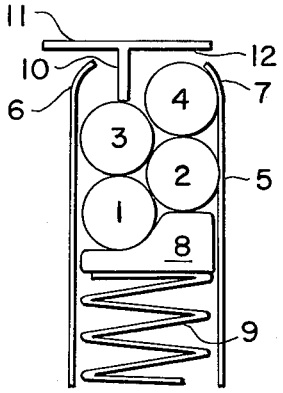
FIG. 2 is a similar to FIG. 1 but an emptying device is partly inserted into the magazine.

FIG. 2 shows the magazine and cartridges in the same condition as FIG. 1, but a stud 10 has been inserted between lips 6 and 7 and is contacting cartridge 3. The stud is fixed on a mounting plate 11 which may be independent, or may be part of a firearm or firearm accessory. It will be noted in FIG. 2 that there is a slight gap between surface 12 of plate 11 and lips 6 and 7.

Figure 3:
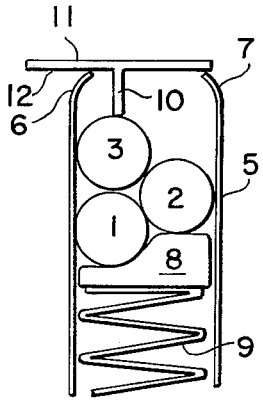
FIG. 3 is similar to FIG. 2 but the emptying device is fully inserted and the top-most cartridge has been dropped out of the magazine.

In FIG. 3 the gap has been closed by exerting thrust on the magazine toward the stud. (The same effect can be produced by thrusting the stud into the magazine.) This displaces the stack of cartridges away from the lips so that cartridge 4 is no longer engaged by friction against lip 7. The magazine being held in a proper position, the cartridge can then slide out under the influence of gravity.

Figure 4:
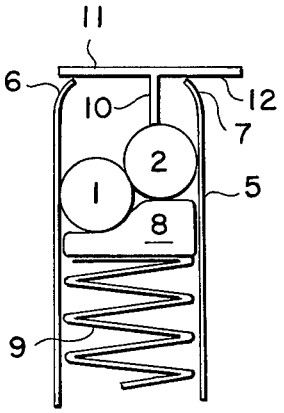
FIG. 4 shows the effect of moving the emptying device while it is fully inserted into the magazine.

Assuming the stud to be fixed, the magazine is now moved to the left, and the stack of cartridges will move toward the lips until cartridge 2 contacts stud 10 as shown in FIG. 4. In this condition cartridge 3 is no longer retained by friction against lip 6 and has fallen out.

This procedure is repeated for each cartridge, the only difference being that as the last cartridge slides out, stud 10 will be depressing follower 8. Of course the dimensions of stud 10 must be so chosen that it can depress the stack only slightly, to release one cartridge. Surface 12 of plate 11 sets a limit on such displacement of the stack when it contacts the lips of the magazine.

Figure 5:
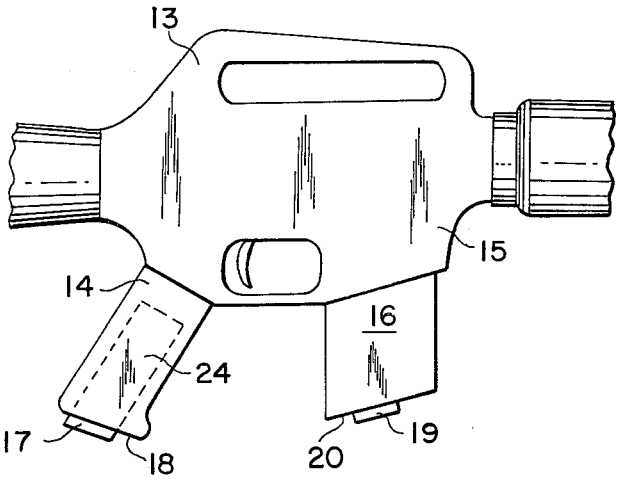
FIG. 5 shows a partial view of a firearm having magazine emptying devices affixed thereto.

The length of the stud, parallel to the longitudinal axis of the cartridges in the magazine, should be so chosen as to be suitable for exerting thrust on a sufficient portion of the length of the second cartridge to maintain the equilibrium of the stack against the thrust of the spring. The length may vary for different cartridges, or different magazines. In FIG. 5 it may be noted that stud 19 is shown approximately one half the front-to-rear dimension of magazine 16, which is approximately the length of the contained cartridges. In actual practice it has been found that studs as short as one third or even one fourth of the length of the cartridge can be used in some cases. The width of the stud relative to the diameter of the cartridge can also vary. It is not intended to limit the disclosure to any particular dimension relative to the size of a cartridge or a magazine.

FIG. 5 shows a portion of a firearm having a receiver 13, a firing grip 14, a magazine housing 15, and a magazine 16 inserted in said housing. FIG. 5 is not intended to represent any particular model of firearm.

Protruding from grip 14 is stud 17. The lower surface 18 of the grip can serve to limit the insertion of the stud into a magazine in the manner described hereinbefore.

It is not necessary to mount the stud at any certain position on the firearm. Several possibilities can be suggested. For example stud 19 can protrude from below magazine 16, with the lower surface 20 of the magazine serving as a limit in the manner previously described for surface 18. In this instance one magazine, with stud, could be used to empty another magazine.

Figure 6:
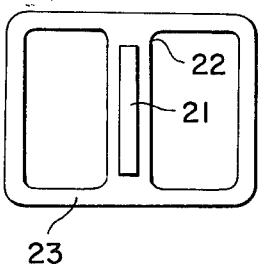
FIG. 6 shows a firearm sling buckle having a magazine emptying device affixed thereto.

Various other possibilities can be suggested for mounting the stud so as to be always conveniently available. FIG. 6 shows a stud 21, fixed on rib 22 of buckle 23, which is intended for use with the sling of a firearm. The surface of buckle 23 serves as a limit for insertion of the stud into a magazine.

An emptying device as shown in FIG. 2, 3, and 4 could be made as a separate item and carried in the hollow space 24 indicated by the broken lines on grip 14 in FIG. 5. Another possibility would be to make stud 17 detachable, or retractable, for storage in the said space 24.

Figure 7:
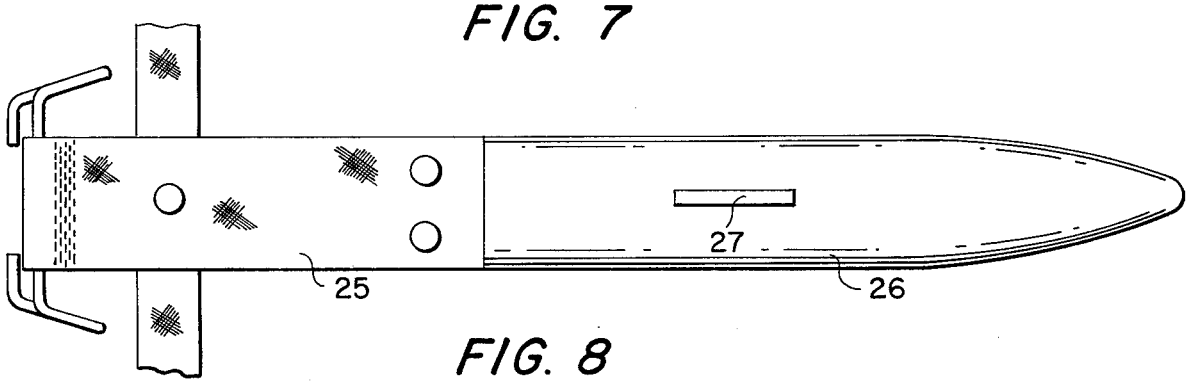
FIG. 7 shows a bayonet scabbard having a magazine emptying device affixed thereto.

FIG. 7 shows an emptying device mounted on a bayonet scabbard. The scabbard has a belt loop 25 and a sheath 26. Fixed on the flat surface of the sheath is stud 27 which is used as an emptying device, while the surface of the sheath limits insertion of the stud into a magazine.

Figure 8:
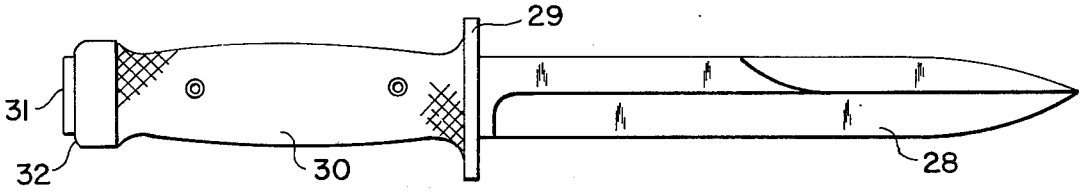
FIG. 8 shows a bayonet having a magazine emptying device affixed thereto.

FIG. 8 shows a bayonet having a blade 28, a guard 29, and a grip 30. Protruding from the base of the grip is stud 31 which serves as an emptying device, while surface 32 of the grip serves to limit insertion of the stud into a magazine. An alternate location for the stud could be on guard 29.

Figure 9:
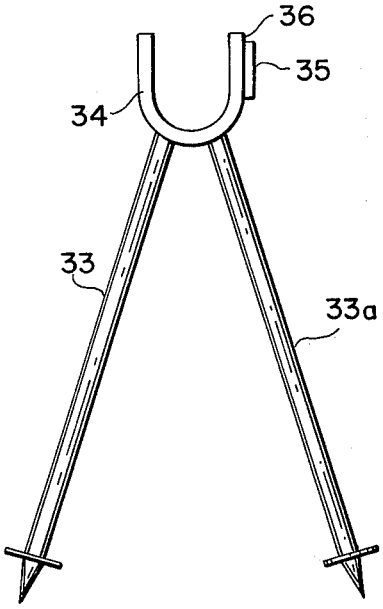
FIG. 9 shows a firearm bipod having a magazine emptying device affixed thereto.

FIG. 9 shows a bipod having legs 33 and 33a and a collar 34 for supporting a firearm. Stud 35 protruding from the side of the collar can serve as an emptying device while surface 36 of the collar can limit insertion of the stud into a magazine.

Figure 10:
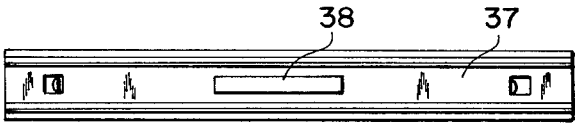
FIG. 10 shows a cartridge clip having a magazine emptying device affixed thereto.

FIG. 10 shows the back of a cartridge clip 37 having stud 38 affixed thereto. The surface of the clip can limit insertion of the stud into a magazine.

Figure 11:
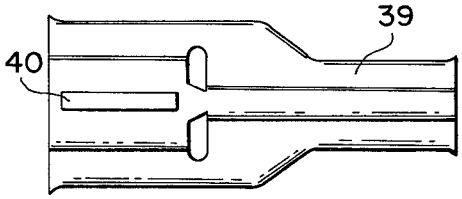
FIG. 11 shows a clip guide having a magazine emptying device affixed thereto.

FIG. 11 shows the back of a clip guide 39 with stud 40 affixed thereto. The surface of the guide can limit insertion of the stud into a magazine.

Figure 12:
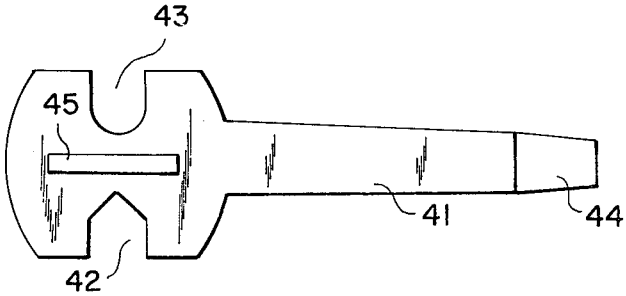
FIG. 12 shows a firearm tool having a magazine emptying device affixed thereto.

FIG. 12 shows a firearm tool 41 having wrench slots 42 and 43, and a screwdriver end 44. Mounted on the flat surface of the tool is a stud 45 which can serve as an emptying devicej while the flat surface of tool limits insertion of the stud into a magazine.

There is thus disclosed a simple emptying device which can be mounted on firearms or their accessories. The illustrations are exemplary only and should not be considered as limiting the invention.

What I claim is:

1. A magazine emptying device comprising: mounting means having a stud fixed integrally thereto, said stud being inserted into a feed mouth of a magazine and positionally adapted for exerting thrust against a cartridge in said magazine adjacent to the cartridge nearest said feed mouth; and means to limit insertion of said stud into said feed mouth.

2. A magazine emptying device as set forth in claim 1 further characterized by said mounting means comprising a surface of a firearm.

3. A magazine emptying device as set forth in claim 1 further characterized by said mounting means comprising part of a bayonet.

4. A magazine emptying device as set forth in claim 1 further characterized by said mounting means comprising part of a scabbard.

5. A magazine emptying device as set forth in claim 1 further characterized by said mounting means comprising a cartridge clip.

6. A magazine emptying device as set forth in claim 1 further characterized by said mounting means comprising a clip guide.

7. A magazine emptying device as set forth in claim 1 further characterized by said mounting means comprising a bipod.

8. A magazine emptying device as set forth in claim 1 further characterized by said mounting means comprising a sling buckle.

* * * * *